US006789888B2

(12) United States Patent
Kiyama

(10) Patent No.: US 6,789,888 B2
(45) Date of Patent: Sep. 14, 2004

(54) RECORDING MEDIUM CONVEYANCE APPARATUS AND RECORDING APPARATUS COMPRISING RECORDING MEDIUM CONVEYANCE APPARATUS

(75) Inventor: Kota Kiyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/942,577

(22) Filed: Aug. 31, 2001

(65) Prior Publication Data

US 2002/0027588 A1 Mar. 7, 2002

(30) Foreign Application Priority Data

Sep. 5, 2000 (JP) ..... 2000-268212
Aug. 23, 2001 (JP) ..... 2001-252489

(51) Int. Cl.[7] ..... B41J 2/01
(52) U.S. Cl. ..... 347/104; 400/636; 271/193
(58) Field of Search ..... 347/104; 271/198, 271/264, 7, 275, 256, 258.01, 199, 193; 101/37, 232; 400/635; 361/212, 214, 220, 221, 225; 399/315, 316, 397, 348, 18, 19, 20, 21, 22, 279, 303–312

(56) References Cited

U.S. PATENT DOCUMENTS 4,549,826 A * 10/1985 Stoeberl ..... 400/708
5,502,545 A * 3/1996 Tsuruoka ..... 355/207
5,555,076 A * 9/1996 Yoshiyama ..... 355/208
6,309,064 B1 * 10/2001 Tanno et al. ..... 347/104

FOREIGN PATENT DOCUMENTS

JP 2000143025 * 5/2000

* cited by examiner

*Primary Examiner*—Stephen D. Meier
*Assistant Examiner*—Ly T Tran
(74) *Attorney, Agent, or Firm*—Fitzpatrick, Cella, Harper & Scinto

(57) ABSTRACT

In conveyance of a recording medium, when a jam occurs and a belt is stopped, the recording medium loaded on the conveyance belt can be easily removed. The apparatus for rotating the conveyance belt and supplying electricity to the belt so as to attract and convey a recording medium on the surface of the belt includes an electrical feeding member capable of supplying electricity to the conveyance belt comprising portions to be fed at a first voltage value for attracting the recording medium or at a second voltage value for releasing the attraction of the recording medium; conveyance failure detection elements for detecting a conveyance failure; and a control portion for performing control of the conveyance belt and the electrical feeding member based on a detection signal of the conveyance failure detection element. The electrical feeding member supplies electricity to the conveyance belt at the second voltage value when the conveyance failure is detected by the conveyance failure detection element.

9 Claims, 7 Drawing Sheets

RECORDING MEDIUM CONVEYANCE APPARATUS AND RECORDING APPARATUS COMPRISING RECORDING MEDIUM CONVEYANCE APPARATUS

BACKGROUND OF THE INVENTION

1. Field of the Invention

The present invention relates to a recording medium conveyance apparatus for conveying by fastening a recording medium to an endless belt member and a recording apparatus, comprising the recording medium conveyance apparatus, and performing a recording on a recording medium, which is a material to be conveyed.

2. Related Background Art

Conventionally, in the recording apparatus, for example, an ink jet recording apparatus performing a recording by a recording device of an ink jet system, there has been a type using a recording head of a full line type, which can record at high speed with high quality. In this recording apparatus, there has been generally known a method in which an electrically conductive electrode is provided in the endless belt member which conveys the recording medium and given a charge so as to generate an electrostatic force, thereby performing the recording while conveying by fastening the recording medium to the belt member.

A background technique of the recording medium conveyance apparatus leading to the completion of the present invention will be described below with reference to FIG. 1 and FIG. 4 which are also the embodiments to which the present invention is adapted.

As shown in FIG. 4, on a conveyance belt 31 as an endless belt member, fastening power generation means constituted by an electrode plate 36*a* made of an electrically conductive metal, a base layer 36*c*, a surface layer 36*d*, a member to be fed 36*e* and the like are integrally or movably provided with the movement of the conveyance belt. The member to be fed 36*e* and the surface layer 36*d* are constituted in such a manner as to be substantially on the same flat surface.

As shown in FIG. 4, electrical feeding means for supplying electricity to the conveyance belt 31 is constituted by an electrical feeding brush 51, an electrical feeding electrode 52 and support member 53. The member to be fed 36*e* is brought into contact with the electrical feeding brush 51 for supplying a charge. From this electrical feeding brush 51, the charge is supplied to the member to be fed 36*e* so as to generate the electrostatic force. In this way, an excellent fastening force can always be generated on the conveyance belt 31.

In FIG. 1, reference numeral 39 denotes a charge elimination brush. By charge-eliminating the conveyance belt 31 by this charge elimination brush 39 so as to eliminate the fastening force, the recording medium (the sheet material) can be smoothly discharged.

Reference numeral 40 denotes a sheet expulsion sensor for detecting a discharge of the recording medium from a recording area. It is constituted in such a manner that, by not detecting the discharge of the recording medium, the failure of a discharge conveyance (a discharge jam) of the recording medium in a discharge portion (not shown) can be detected. When the discharge jam occurs, a belt driving is allowed to be promptly interrupted.

Reference numerals 91, 92, 93, 94 denote recording medium float detection sensors for detecting a float (gap) of the conveyance belt from the recording medium. This sensor is arranged just in front of each recording device (an ink jet recording head) 7Y, 7M, 7C, 7K. This is because when the top end or the rear end of the recording medium passes under the recording device in a state of being floated from the belt surface, the recording medium damages the surface of the recording device by rubbing the surface (the ink discharging port forming surface) of the recording device and, therefore, in order to prevent this, the sensor was provided. That is, if a float of the recording medium is detected in advance by the recording medium float detection sensor and the driving (the conveyance operation) of the conveyance belt is stopped, the passing under each recording device of the floated recording medium can be prevented in advance.

However, in a constitution based on the above described background technique, the jam processing after the occurrence of a jam was detected and the conveyance belt 31 was stopped was complicated. Usually, when the jam occurs, though the conveyance belt 31 is stopped in order to protect each recording device, because the conveyance belt 31 is put into a conveyance stopped state with the recording medium loaded as it is at this time, in such a stopped state, the charge elimination brush 39 could only charge eliminate a very narrow portion in contact with the conveyance belt 31. Accordingly, the recording medium which remains to be loaded on the conveyance belt 31 remains to be substantially fastened by the conveyance belt 31, and for this reason, the recording medium which is in a state of being loaded on the conveyance belt 31 was in a very difficult state for the operator to remove.

SUMMARY OF THE INVENTION

It is an object of the present invention to provide a recording medium conveyance apparatus allowing the recording medium which remains to be loaded on the conveyance belt to be easily removed and a recording apparatus comprising the recording medium conveyance apparatus when a jam occurs and a belt stops without installing a new member for charge-eliminating.

It is another object of the present invention to provide a recording medium conveyance apparatus for rotating an endless belt member and supplying electrical power to the belt member so as to convey and absorb the recording medium (the sheet material) to the surface of the belt member or the recording apparatus comprising the recording medium conveyance apparatus and performing a recording on the recording medium by the recording device, comprising: electrical feeding means capable of supplying electricity to the belt member comprising a portion to be fed by a first voltage value for fastening the recording medium or by a second voltage value for releasing the fastening of the recording medium; conveyance failure detection means for detecting the conveyance failure of the recording medium; and control means for performing the control of the belt member and the electrical feeding means based on the conveyance failure detection signal of the conveyance failure detection means, wherein when the conveyance failure is detected by the conveyance failure detection means the recording apparatus comprising the recording medium conveyance apparatus in which the electrical feeding means supplies electricity to the belt member at the second voltage value and the recording medium conveyance apparatus is provided.

DETAILED DESCRIPTION OF THE PREFERRED EMBODIMENTS

Various modes of the recording medium conveyance apparatus, which adopts the present invention, and the recording apparatus comprising the recording medium conveyance apparatus will be described below in detail with reference to the drawings.

(First Embodiment)

A recording apparatus according to a first embodiment will be described by using FIG. 1 to FIG. 7.

Figure 1:
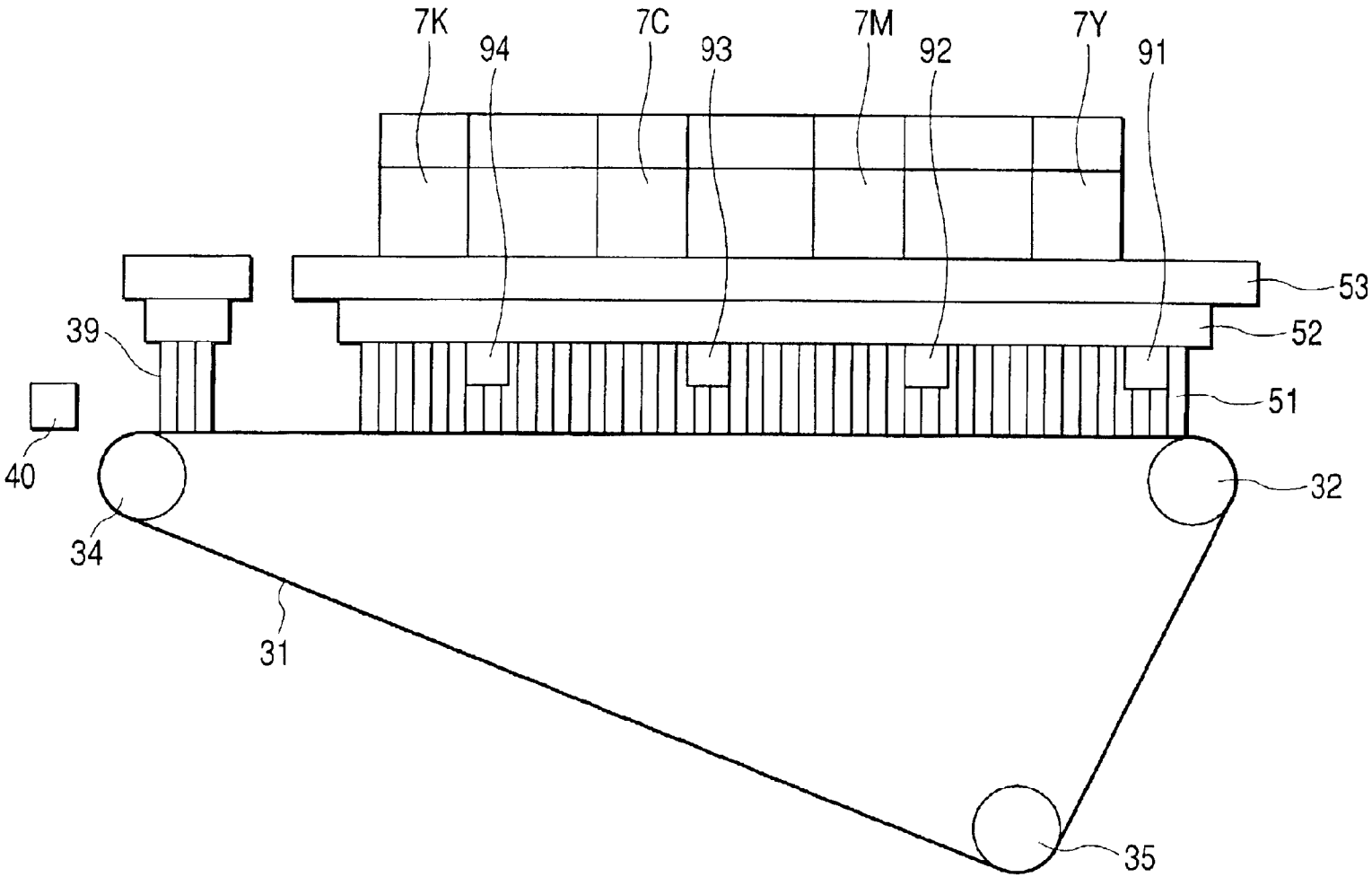
FIG. 1 is an explanatory view of a positional relation among an fastening force generation means, a conveyance belt and a recording device of a first embodiment.
Figure 2:
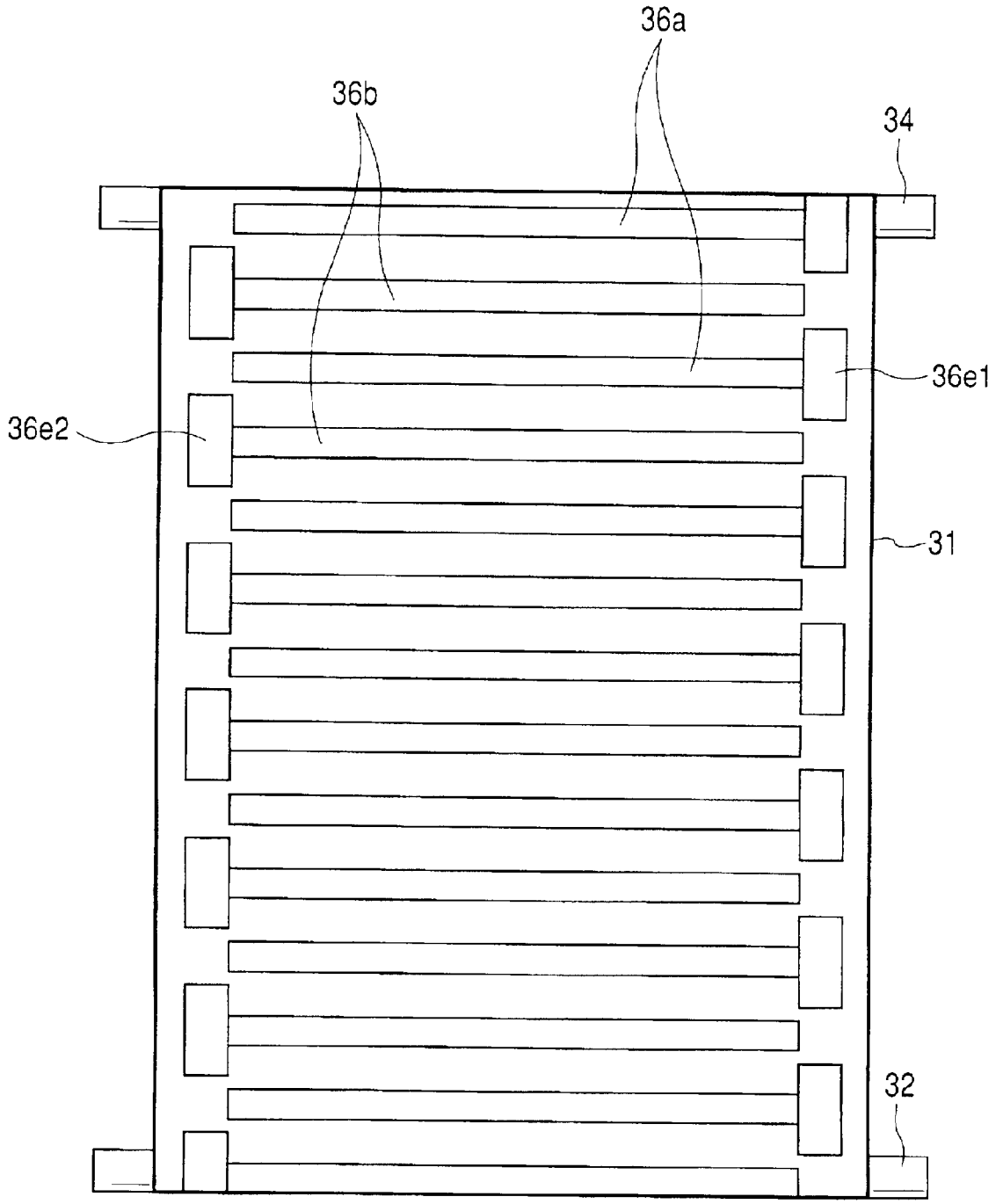
FIG. 2 is an explanatory view of the conveyance belt of the first embodiment viewed from above.
Figure 3:
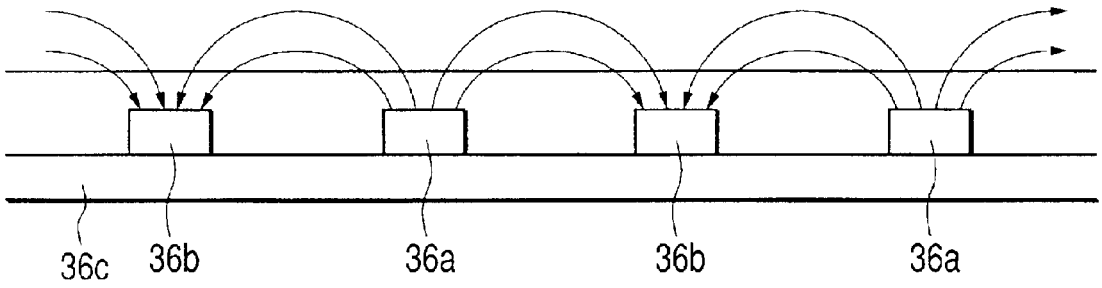
FIG. 3 is an explanatory view of the inside of the conveyance belt.
Figure 4:
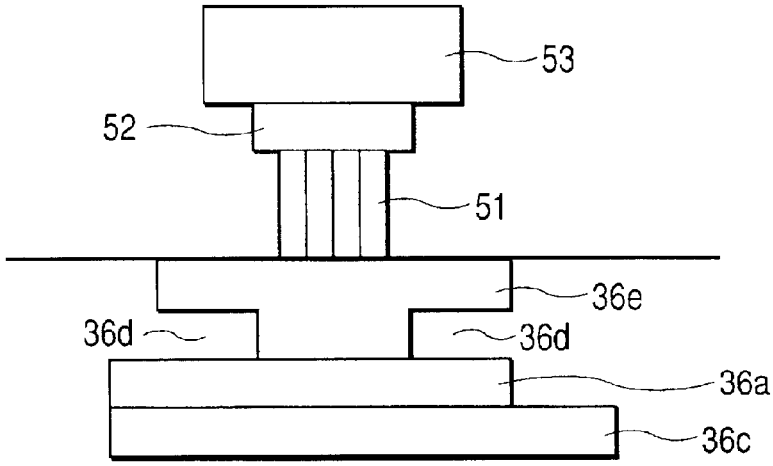
FIG. 4 is an explanatory view of the fastening force generation means of the first embodiment.
Figure 5:
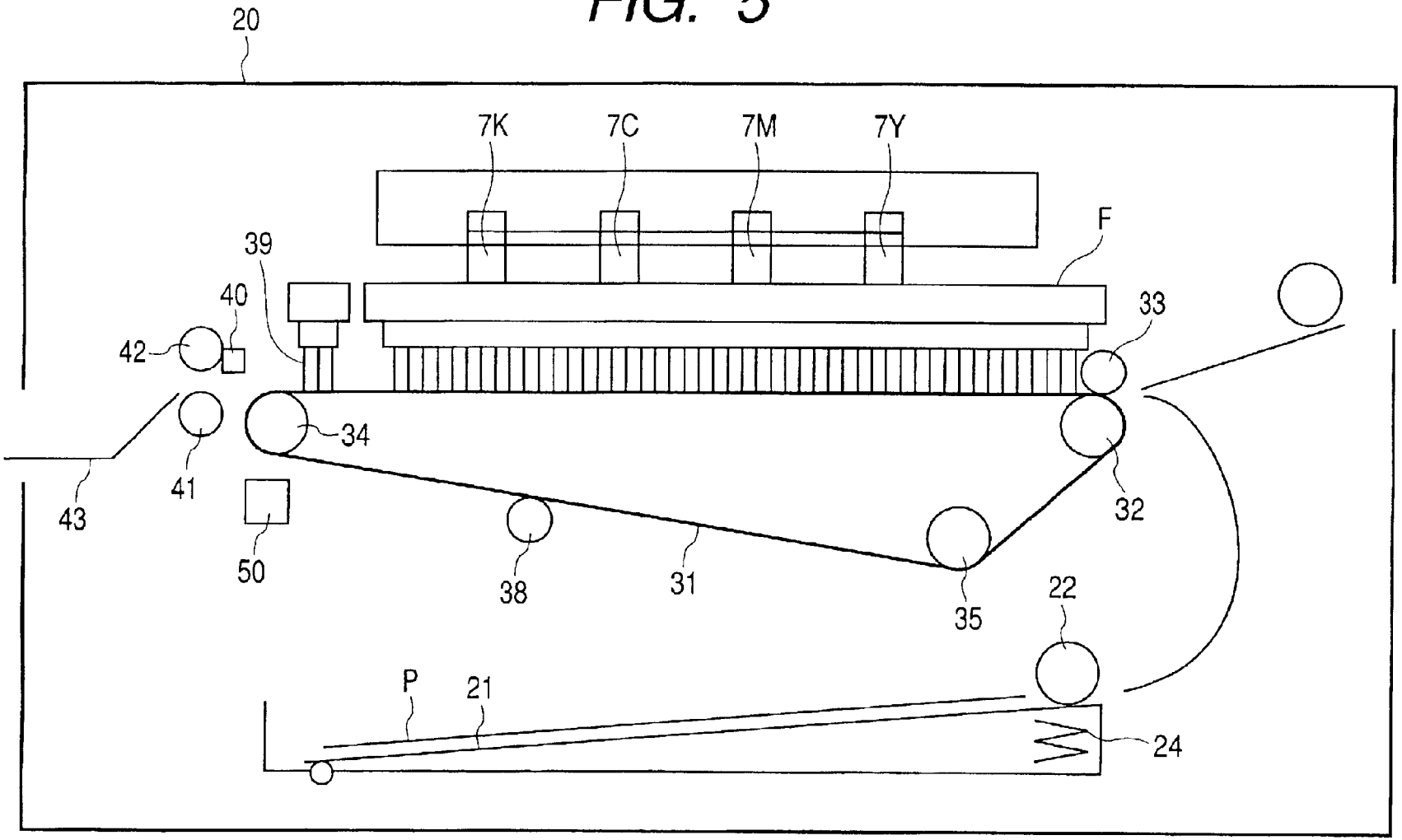
FIG. 5 is a diagram of an entire recording apparatus of the first embodiment.
Figure 6:
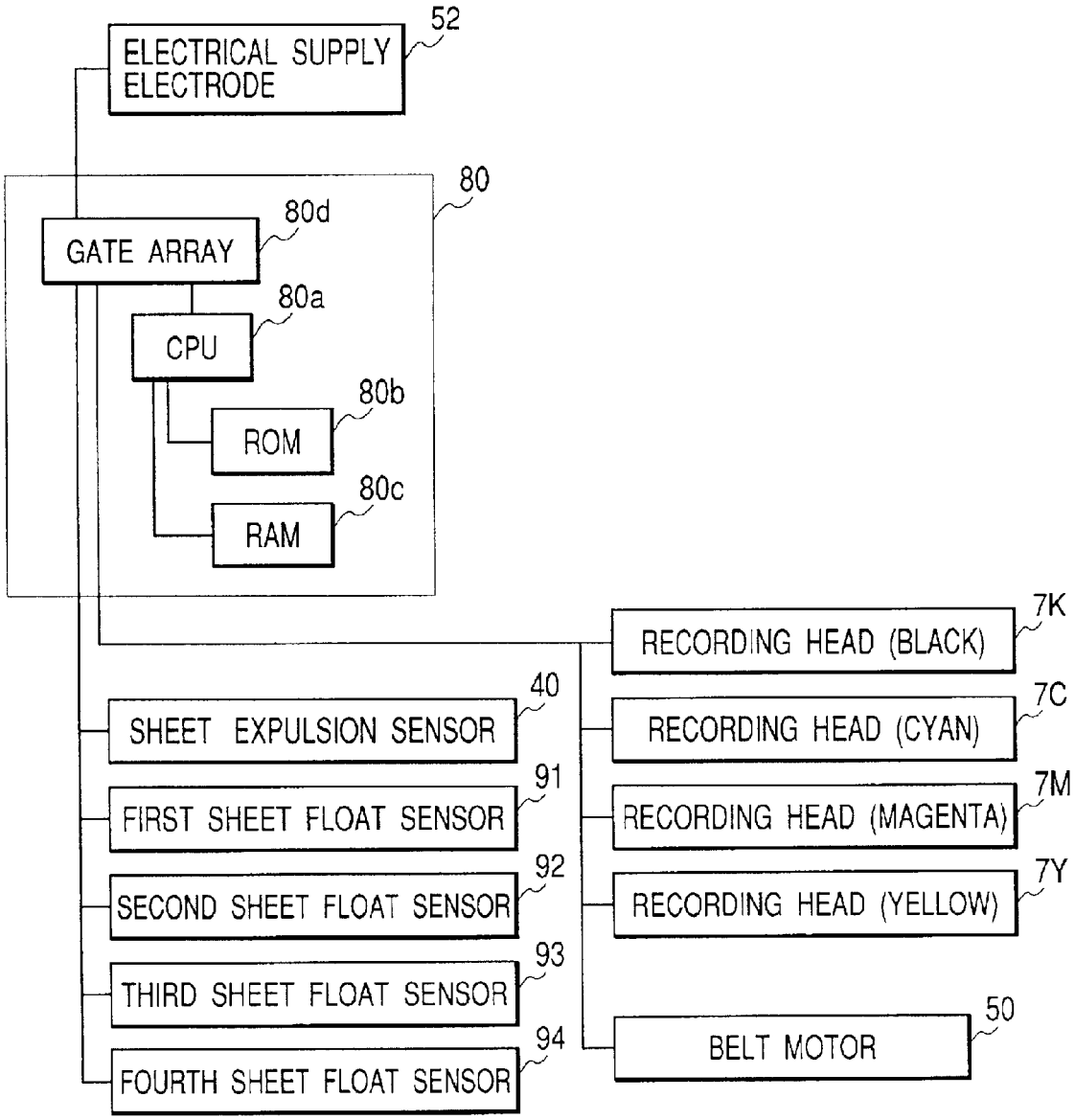
FIG. 6 is an explanatory view of a control block of the recording apparatus of the first embodiment.
Figure 7:
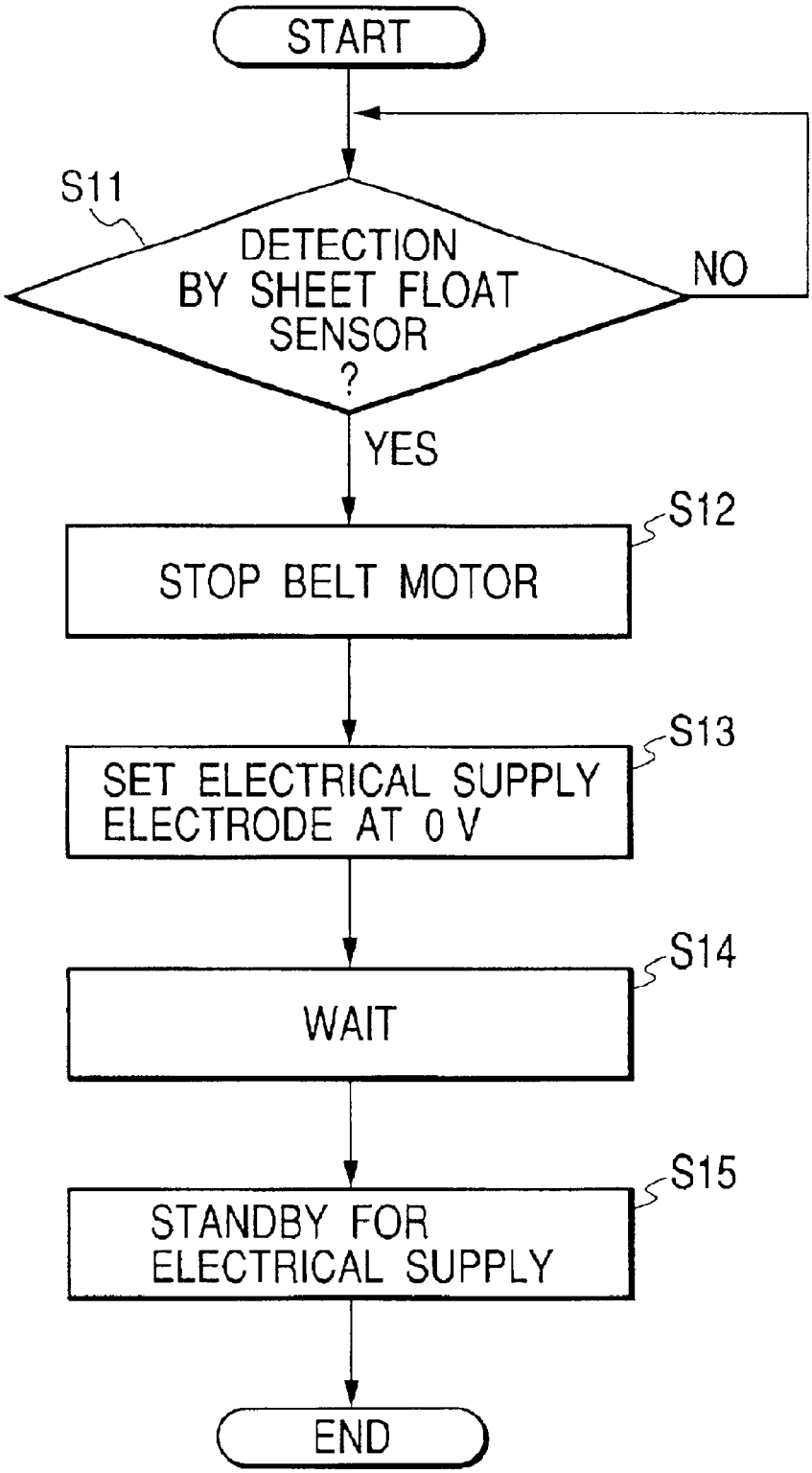
FIG. 7 is an explanatory view of a control flow chart of the recording apparatus of the first embodiment.

FIG. 1 is an explanatory view of electrical feeding means of the present invention. FIG. 2 is an explanatory view of a conveyance belt 31 and fastening force generation means 36. FIG. 3 is an explanatory view regarding the generation of the fastening force of the fastening force generation means 36. FIG. 4 is an explanatory view of an electrical feeding to a conveyance belt from electrical feeding means. FIG. 5 is a sectional view showing the whole constitution of the recording apparatus of the present invention. FIG. 6 is a view showing a control block of the apparatus of the present invention. FIG. 7 is a view showing a control flow chart of the present invention.

As shown in FIG. 1, the electrical feeding means is constituted by an electrical feeding brush 51, an electrical feeding electrode 52 and a support member 53. The right side of FIG. 1 is a feed paper side for feeding a sheet material such as a paper and the like as a recording medium and the left side is a discharge side for expelling the same. The sheet material such as the recording paper and the like is conveyed from right to left. The electrical feeding brush 51 is in contact with a portion to be fed (to be described later) of the conveyance belt 31 as a belt member and supplies an electrical energy to the portion to be fed of the conveyance belt 31.

The voltage value given by this electrical feeding means to the portion to be fed of the conveyance belt 31 is usually 1.5 kV (a first voltage value) at the time of conveyance.

On the other hand, when a jam occurs during the conveyance of the sheet material and the driving of the conveyance belt 31 is interrupted, the value of the voltage supplied by this electrical feeding means to the portion to be fed of the conveyance belt 31 becomes 0 V (a second voltage value). In this way, the charge stored in the electrode plate of the conveyance belt 31 is eliminated and the fastening force generated in the conveyance belt 31 is vanished.

Note that, in the upstream of the sheet material conveyance direction of each recording device 7Y, 7M, 7C, 7K as recording means, a first sheet float sensor 91, a second sheet float sensor 92, a third sheet float sensor 93, a fourth sheet float sensor 94 as the recording medium float detection means are arranged, respectively. In the discharge portion, an expulsion sensor, namely a sheet expulsion sensor 40 used as the discharge conveyance failure detection means is arranged.

As shown in FIG. 2, the fastening force generation means 36 of the conveyance belt 31 is constituted by an electrode plate 36*a* and an earth (ground) plate 36*b* and is comb-shaped as shown in FIG. 2. These plates are facing each other in the direction orthogonal (or may be in the crossing direction) to the belt conveyance direction and provided in plurality in the conveyance belt 31 in such a manner that a concave portion and a convex portion come into each other.

On both sides of the conveyance direction of the conveyance belt 31, portions to be fed 36*e*1, 36*e*2 are provided in a square shape having sides of the width longer than the width of each electrode plate 36*a*, 36*b*. The electrical feeding brush 51 which is conductive is electrically conductibly brought into contact with the portions to be fed 36*e*1, 36*e*2 by a predetermined pressure.

By this electrical feeding brush 51, a positive voltage is applied to the portion to be fed 36*e*1 from a high voltage power source (not shown). On the other hand, the portion to be fed 36*e*2 is made conductible to the earth. Note that the electrical feeding brush 51 is preferable to be of a conductive material having a volume resistivity of $10^{-4}$ Ωcm to $10^{-5}$ Ωcm.

Next, the generation of the fastening force of the fastening force generation means will be explained.

As shown in FIG. 3, when a voltage is applied to the electrode plate 36*a*, an electric force is generated in FIG. 3 in an arrow mark direction, thereby forming an electrical line of force. By the potential difference between the electrode plate 36*a* and the earth plate 36*b*, a fastening or attraction force is generated above the conveyance belt 31 and the recording medium P on the conveyance belt 31 is fastened or attracted thereto.

Here, because the volume resistivity (Ωcm) is expressed as a base layer>a surface layer in the present invention, the electrical line of force generated becomes larger on the upper surface of the belt so that the fastening force is allowed to become larger.

Next, the electrical feeding from the electrical feeding means to the conveyance belt will be described.

As shown in FIG. 4, the fastening force generation means 36 is constituted by an electrode plate 36*a* made of an electrically conductive metal, an earth plate 36*b*, a base layer 36*c*, a surface layer 36*d*, and the member to be fed 36*e* and provided in such a manner as to be integrated with the conveyance belt 31 or move along with the movement of the conveyance belt 31. The electrical feeding means is, as described above, constituted by the electrical feeding brush 51, an electrical feeding electrode 52 and a support material 53. This member to be fed 36*e* is substantially in the same flat surface as the surface layer 36*d*. The electrical feeding brush 51 is brought into contact with the member to be fed 36*e* by a predetermined pressure and supplies electricity to the same.

The electrode plate 36*a* and the earth plate 36*b* are protected and provided in such a manner as to be sandwiched between the base layer 36*c* and the surface layer 36*d* which are made of a dielectric material. Both of the base layer 36*c* and the surface layer 36*d* are constituted by a synthetic resin such as a polyethylene and a polycarbonate having a size of $10^{15}$ Ωcm to $10^{17}$ Ωcm and $10^{10}$ Ωcm to $10^{14}$ Ωcm, respectively. The surface layer 36*d* and the upper surface of the member to be fed 36*e* are subjected to the processing of a fluoroethylene resin and the like and its water repellency is maintained in an excellent state.

Next, the whole constitution of the recording apparatus of one embodiment according to the present invention will be described by referring to FIG. 5. Particularly, the recording portion, in which recording on a sheet material and the like by a sheet feeding portion, a conveyance portion and a recording head is executed, and a discharging portion in the recording apparatus will be described in order.

The sheet feeding portion is capable of rotating with an axis of rotation as a center, in which a pressure plate 21 to be loaded with the recording medium P and a sheet feeding body of rotation 22 for feeding the recording medium P are combined with a base 20, and energized to the sheet feeding body of rotation 22 by a pressure spring 24. In the pressure plate 21, there exist a separation pad (not shown) having a large friction factor for preventing a heavy feeding of the recording medium P and a separation claw (not shown) for separating the recording medium. In addition, a release cam (not shown) for releasing the abutting of the pressure plate 21 against the sheet feeding body of rotation 22 is provided.

In the above described constitution, in a standby state, the release cam pushes down the pressure plate 21. In this way, the abutting of the pressure plate 21 against the sheet feeding body of rotation 22 is released. When, in this state, the driving force of a conveyance roller 32 is transferred to the sheet feeding body of rotation 22 and the release cam by gears and the like, the release cam is separated from the pressure plate 21 and the pressure plate 21 is lifted. Accompanied with this, the sheet feeding body of rotation 22 and the recording medium P abut against each other and, further accompanied with the rotation of the sheet feeding body of rotation 22, the recording medium P is picked up and the sheet feeding starts. The sheet feeding body of rotation 22 continues to rotate until the recording medium P is conveyed to the conveyance portion.

The conveyance portion absorbs or attracts the recording medium P and comprises the conveyance belt 31 as the conveying belt member and a paper rear end sensor not shown (a PE sensor).

The conveyance belt 31 is driven by a driving roller 34 and stretched across among the driving roller 34, a slave roller 32 and a tension giving roller 35. The driving roller 34 has a belt motor 50 as a driving source. The conveyance belt 31 is made of a synthetic resin such as a polyethylene and is in an endless belt shape.

Reference character F denotes electrical feeding means. This electrical feeding means F will be described in detail with reference to a separate drawing. The electrical feeding means F applies a voltage of about 0.5 kV to about 10 kV to the conveyance belt 34 so that the recording medium P is fastened to the conveyance belt 31 in a tightly adhering state.

The conveyance belt 31 moves at a speed of 170 mm/sec for the standard recording mode. The distance between before and after the recording medium (hereinafter, referred to as the distance between papers) at the time when a plurality of recording media are continuously fastened and conveyed on the conveyance belt 31 is 10 cm if a recording paper of A4 size (Japanese Industrial Standard) is used in the standard mode. Further, if the recording medium is a recording paper having A3 size (Japanese Industrial Standard), the distance between papers is 15 cm.

In the position opposing to the slave roller 32, a pinch roller 33 which is pressed against the conveyance belt 31 and slavishly moves is arranged. In the downstream of the conveyance direction of the slave roller 32 and in the position opposing to the sheet material and the like conveyed by the conveyance belt 31, recording heads 7K, 7C, 7M, 7Y as recording devices supported by device support members are arranged. The resolution of this recording head is 600 dpi and the head is an ink jet recording head of a line type in which a plurality of nozzles corresponding to the whole width of the sheet material are arranged in the direction orthogonal to the conveyance direction.

These recording heads emit ink by giving a thermal energy to the ink by a heater and the like. That is, by this thermal energy, the ink generates a film boiling and, by the change of pressure produced by the growth or the contraction of bubbles in the ink by this film boiling, the ink is emitted from a nozzle, thereby forming an image on the recording medium P.

Reference numeral 39 denotes a charge elimination brush. The charge elimination brush 39 is conducted to the earth. It eliminates the fastening force between the recording medium (the sheet material) P in which the image forming was completed by the recording head and the conveyance belt 31 just before the medium is discharged from the recording portion.

A discharge portion is constituted by a discharge roller 41 and a gear-shaped body of rotation (discharge slave body of rotation) 42. The recording medium P in which the image was formed is held between the discharge roller 41 and the gear-shaped body of rotation 42 and conveyed and discharged to a discharge tray 43. A sheet expulsion sensor 40 checks the existence/non-existence of the recording medium P in the discharge portion.

Note that reference numeral 38 denotes a cleaning roller, which is used when the conveyance belt 31 is to be cleaned.

A control block of the apparatus of the embodiment according to the present invention will be described by using FIG. 6.

In FIG. 6, reference numeral 80 denotes a control portion, which is constituted by a CPU 80*a* which moves according to a control program, a ROM 80*b* which houses the program, a memory for use in an operation and a RAM 80*c* which is a memory for storing contamination detection data. A gate array 80*d* is an LSI which, together with the CPU 80*a*, controls a signal to the recording head and a signal to the electrical feeding electrode.

To this control portion 80 as control means, the following to be described are connected.

Reference numeral 50 denotes a belt motor, which is a driving source for rotating the conveyance belt 31. Reference numeral 7K denotes a recording head of black, 7C a recording head of cyan, 7M a recording head of magenta and 7Y a recording head of yellow. Reference numeral 40 denotes the sheet expulsion sensor. Reference numeral 52 denotes the electrical feeding electrode.

Reference numeral 91 denotes a first sheet float sensor, reference numeral 92 a second sheet float sensor, reference numeral 93 a third sheet float sensor and reference numeral 94 a fourth sheet float sensor, which are, as described above, used as recording medium float detection sensors.

A control flow chart by the control means when a conveyance failure occurs will be described by using FIG. 7.

In the present embodiment, as the conveyance failure detection means for detecting a conveyance failure, an example of the case where a sheet float sensor as the recording medium float detection means for detecting a float of the sheet material and the like on the conveyance belt in the vicinity of the recording head is used will be illustrated and described. Here, what is meant by a float from the conveyance belt 31 such as the sheet material and the like is a phenomenon in which the recording medium is separated from the conveyance belt in the recording device direction.

As shown in FIG. 7, when a jam attributable to the so-called sheet float phenomenon occurs, at step S11, the sheet float sensor emits a detection signal concerning the occurrence of the jam. Based on this detection signal, at step S12, the belt motor 50 is stopped. Subsequently, at step S13, all the applied voltages of the electrical feeding electrode 52 are changed to 0 V (a second voltage value) and the charge elimination of conveyance belt 31 is performed. At this step S13, the fastening force of the conveyance belt 31 can be vanished. At the next step S14, the apparatus is in a wait state for a predetermined length of time. This is a wait corresponding to the time required for the elimination process at the preceding process (the step S13). At step S15, the apparatus is in a standby state so that the electrical feeding can be made for generating the fastening force when the usual conveyance operation starts again.

As described above, according to the present embodiment, when a jam occurs, by eliminating the fastening force of the conveyance belt 31 after the conveyance belt 31 was stopped, the recording medium (the sheet material) loaded on the conveyance belt 31 as it is can be easily removed.

(Second Embodiment)

In the above described embodiment, though the conveyance belt 31 was stopped when a jam occurred, in the present embodiment, when the sheet material on the conveyance belt 31 is in a position opposing at least to any of the recording heads 7K, 7C, 7Y, 7M, in the case where the position is recognized based on the signals from the sheet float sensors 91, 92, 93, 94, the conveyance belt 31 is moved at a sufficiently lower speed than the conveyance speed at the usual recording execution in an opposite direction and the sheet material is discharged from the recording portion and, after that, by the method described in the first embodiment, the fastening force of the conveyance belt 31 is allowed to be vanished. In this way, such an event can be prevented in which an operator attempts forcibly to take out the sheet which exists in a narrow space between the recording head and the conveyance belt only to damage the recording head due to rubbing of the sheet material and the recording head against the ink discharge port forming surface.

(Third Embodiment)

A recording apparatus according to a third embodiment will be described by using FIG. 8.

Figure 8:
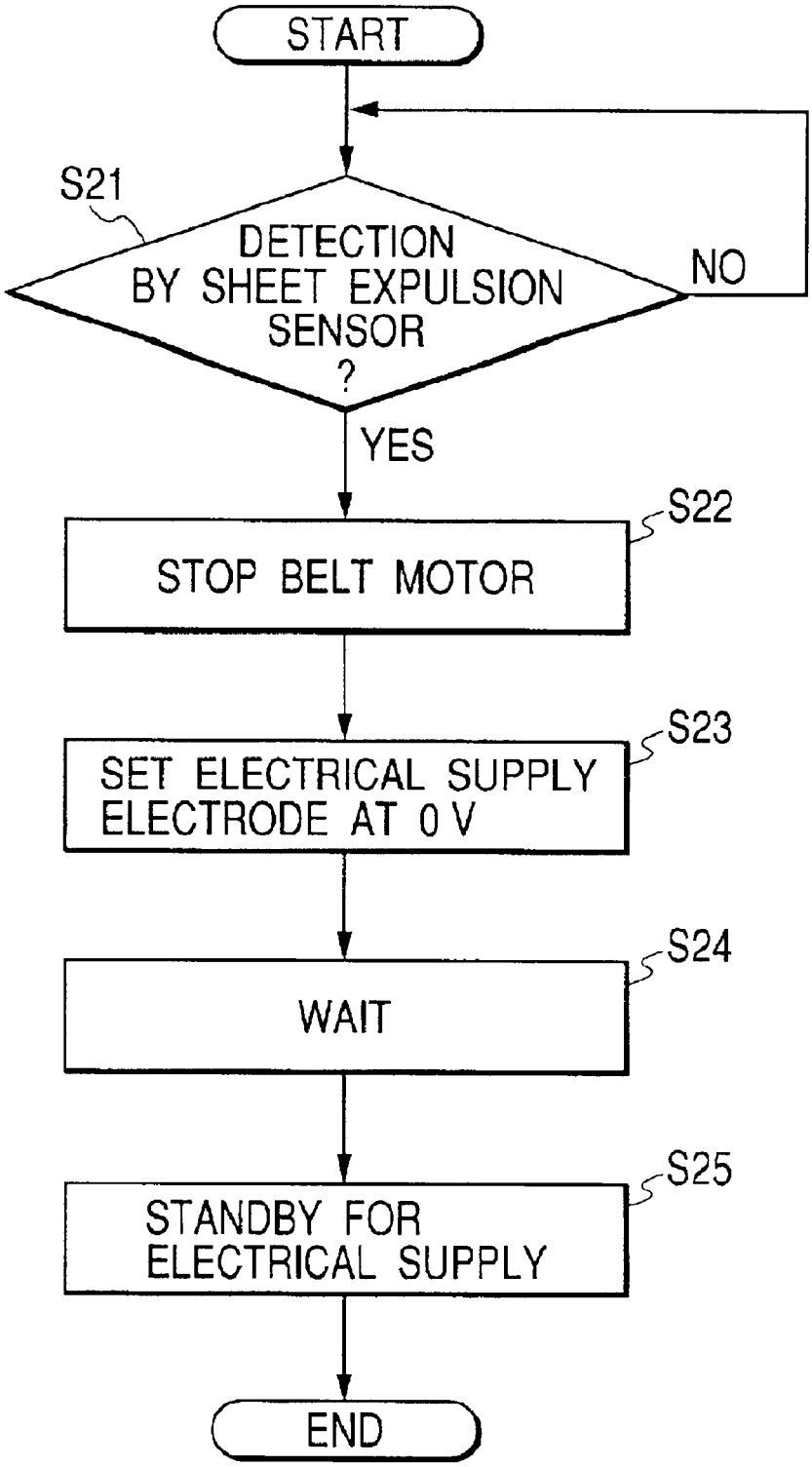
FIG. 8 is an explanatory view of the control flow chart of the recording apparatus of a third embodiment.

FIG. 8 is a view showing a control flow chart of the present invention and, by using this FIG. 8, the control flow chart when a conveyance failure occurs will be described.

Note that, in the above described embodiment, though as the conveyance failure detection means for detecting a conveyance failure, an example of the case where a sheet float sensor as the recording medium float detection means for detecting a float of the sheet material and the like on the conveyance belt 31 in the vicinity of the recording head was used was illustrated, in the present embodiment, an example of the case where the sheet expulsion sensor 40 as the discharge conveyance failure detection means for detecting a jam of the sheet material and the like in the vicinity of the discharge portion is used will be illustrated and described.

As shown in FIG. 8, when a jam occurs at the discharge portion, the control portion 80 which recognizes that a conveyance failure having occurred based on the signal from the sheet expulsion sensor 40 at step S21 stops the belt motor 50 at step S22. Subsequently, at step S23, all the applied voltages of the electrical feeding electrode 52 are changed to 0 V (a second voltage value) and the charge elimination of the conveyance belt 31 is performed. At this step S23, the fastening force of the conveyance belt 31 can be vanished. At the next step S24, the apparatus is in a wait state for a predetermined length of time. This is a wait corresponding to the time required for the charge elimination process at the preceding process (the step S23). At step S25, the apparatus is in a standby state so that the electrical feeding can be made for generating the fastening force when the usual conveyance operation starts again.

As described above, according to the present embodiment also, when a jam occurs, by eliminating the fastening force of the belt after the belt was stopped, a conveyance sheet, which is loaded on the belt as it is, can be easily removed.

(Other Embodiments)

In the above described embodiments, while as the conveyance failure detection means for detecting the conveyance failure, the sheet float sensor as the recording medium float detection means in the first and the second embodiments and the sheet expulsion sensor as the discharge conveyance failure detection means in the third embodiment were illustrated, the present invention is not limited to this.

For example, both of the above described sensors may be combined and used or a constitution may be such that another type of detection means is used.

Further, in the above described embodiments, though an example of the case where the electrical feeding voltage (a first voltage value) to the conveyance belt for fastening the recording medium was taken as 1.5 kV was illustrated, the present invention is not limited to this, but may be of another voltage value.

Further, though an example of the case where the electrical feeding voltage (a second voltage value) at the time when the electrical feeding to the conveyance belt was interrupted and the fastening force was eliminated was taken as 0 V was illustrated, the present invention is not limited to this. For example, even if it is 5 V or −5 V, if it is the voltage which can substantially and quickly eliminate the fastening force of the conveyance belt, it may be preferable.

Further, even if the fastening force is not completely eliminated, the potential difference of the adjacent electrodes may be made smaller and only weaken to such an extent that it is safe to remove the recording medium.

Further, though an example of the case where the resolution of the recording head was 600 dpi was illustrated, the present invention is not limited to this, but may be of another resolution (for example, 1200 dpi).

As described above, according to the present embodiments, when a conveyance failure (a jam) of the recording medium occurred, by vanishing the fastening force of the belt member for fastening the recording medium after the belt member was stopped, the recording medium remained to be loaded as it was on the belt material could be easily removed. Further, rather than installing a new member for charge-eliminating, the charge elimination could be easily performed by the present invention.

What is claimed is:

1. A recording apparatus for conveying a recording medium by an endless belt member and performing recording on the recording medium by a recording device, said apparatus comprising:

a plurality of electrodes which line up in such a manner as to be along a surface of the endless belt member that contacts the recording medium;

an electrical feeding member for applying a first electrical voltage to a part of said plurality of electrodes in such a manner that adjacent electrodes of said plurality of electrodes have different potentials so as to attract the recording medium to a position of the endless belt member located directly adjacent to the recording device;

a conveyance failure detection element for detecting a conveyance failure of the recording medium; and a control portion for controlling said electrical feeding member to feed a second electrical voltage value to said part of electrodes in order to reduce or remove an attraction force of the endless belt member at the position directly adjacent the recording device, based on a detection signal of said conveyance failure detection element, wherein said control portion stops the endless belt member in accordance with the detection signal from said conveyance failure detection element, and wherein said control portion controls to reduce or eliminate the attraction force of the endless belt member to the recording medium stopped at the position directly adjacent to the recording device in accordance with the detection signal from said conveyance failure detection element.

2. The recording apparatus according to claim 1, wherein said conveyance failure detection element is a detection element which detects a separation gap of the recording medium on said belt member from said belt member in a direction toward said recording device.

3. The recording apparatus according to claim 1, further comprising a discharge portion for discharging a recorded recording medium outside the apparatus and said conveyance failure detection element is a discharge conveyance failure detection element for detecting the conveyance failure of the recording medium in the vicinity of the discharge portion.

4. The recording apparatus according to any one of claim 1 to claim 3, wherein said recording device is an ink jet recording head for performing recording on the recording medium by emitting ink.

5. The recording apparatus according to claim 4, wherein said ink jet recording head uses thermal energy as energy for emitting the ink.

6. The recording apparatus according to claim 1, wherein said plurality of electrodes are provided in the endless belt member.

7. The recording apparatus according to claim 1, wherein said control portion controls said electrical feeding member to feed the second electrical voltage value to said part of the plurality of electrodes such that the potentials of the plurality of electrodes are equalized.

8. The recording apparatus according to claim 1, wherein said control portion controls said electrical feeding member to feed the second electrical voltage value such that an elimination of a charge in said plurality of electrodes is effected, based on the detection signal of said conveyance failure detection element.

9. A recording apparatus for conveying a recording medium by an endless belt member and performing recording on the recording medium by a recording device, said apparatus comprising:

a plurality of electrodes which line up in such a manner as to be along a surface of the endless belt member that contacts the recording medium;

an electrical feeding member for charging a part of said plurality of electrodes to a predetermined potential in such a manner that adjacent electrodes of said plurality of electrodes have different potentials so as to attract the recording medium to a position of the endless belt member located directly adjacent to the recording device;

a conveyance failure detection element for detecting a conveyance failure of the recording medium; and a control portion for controlling said electrical feeding member to reduce or eliminate the charge of said part of electrodes in order to reduce or remove an attraction force of the endless belt member at the position directly adjacent to the recording device, based on a detection signal of said conveyance failure detection element, wherein said control portion stops the endless belt member in accordance with the detection signal from said conveyance failure detection element, and wherein said control portion controls to reduce or eliminate the attraction force of the endless belt member to the recording medium stopped at the position directly adjacent to the recording device in accordance with the detection signal from said conveyance failure detection element.

* * * * *

UNITED STATES PATENT AND TRADEMARK OFFICE

CERTIFICATE OF CORRECTION

PATENT NO. : 6,789,888 B2
DATED : September 14, 2004
INVENTOR(S) : Kiyama

It is certified that error appears in the above-identified patent and that said Letters Patent is hereby corrected as shown below:

Title page,
Item [56], References Cited, FOREIGN PATENT DOCUMENTS, "JP 2000143025 * 5/2000" should read -- JP 2000-143025 * 5/2000 --

Column 2,
Line 14, "above described" should read -- above-described --.
Line 22, "charge eliminate" should read -- charge-eliminate --.
Line 66, "an" should read -- a --.

Column 5,
Line 20, "above described" should read -- above-described --.

Column 7,
Lines 22 and 47, "above described" should read -- above-described --.

Column 8,
Lines 12, 19 and 22, "above described" should read -- above-described --.

Column 9,
Line 7, "adjacent" should read -- adjacent to --.

Signed and Sealed this

Seventeenth Day of May, 2005

JON W. DUDAS
*Director of the United States Patent and Trademark Office*